United States Patent [19]

Eaton

[11] 4,380,197

[45] Apr. 19, 1983

[54] SAFETY AND ARMING DEVICE/CONTACT FUZE

[75] Inventor: Jefferson O. Eaton, Ridgecrest, Calif.

[73] Assignee: The United States of America as represented by the Secretary of the Navy, Washington, D.C.

[21] Appl. No.: 915,030

[22] Filed: May 26, 1978

[51] Int. Cl.[3] ..... F42C 5/00; F42C 15/00

[52] U.S. Cl. ..... 102/228; 102/229

[58] Field of Search ..... 102/228, 229, 258, 222–225, 102/227, 208

[56] References Cited

U.S. PATENT DOCUMENTS

| | | | |
|---|---|---|---|
| 3,382,805 | 5/1968 | Swaim | 102/228 |
| 3,670,656 | 6/1972 | Donahue et al. | 102/228 |
| 3,677,185 | 7/1972 | Reams | 102/225 |
| 3,710,722 | 1/1973 | Demas et al. | 102/226 |
| 3,768,415 | 10/1973 | Czajkowski et al. | 102/225 |
| 3,927,617 | 12/1975 | Hoelzen et al. | 102/228 |
| 3,938,443 | 2/1976 | Wolski | 102/228 |
| 3,961,577 | 6/1976 | O'Steen | 102/226 X |
| 3,968,751 | 7/1976 | Palifka | 102/228 |
| 3,990,370 | 11/1976 | Campagnuolo et al. | 102/208 |
| 3,994,231 | 11/1976 | Rudeen et al. | 102/228 |

*Primary Examiner*—David H. Brown

*Attorney, Agent, or Firm*—Thomas W. Hennen; W. Thom Skeer; Robert F. Beers

[57] ABSTRACT

A pneumatically operated safe and arm device for use in an ordnance item utilizes cam controlled mechanical interlocks to prevent premature arming. This device also utilizes staticdynamic fluid pressure differential to cause the enabled mechanism to proceed with arming after a predetermined ordnance item velocity has been obtained. This pressure differential operates on a piston and rod to store energy within a flexible coil spring. Energy stored within this spring is subsequently released to power rotation of a disc, thereby aligning an out-of-line explosive train and causing switching functions in an electric arming and fuzing circuit.

8 Claims, 5 Drawing Figures

SAFETY AND ARMING DEVICE/CONTACT FUZE

BACKGROUND OF THE INVENTION

1. Field of the Invention

This invention pertains to safe and arming devices for use in guided missiles, and more particularly to such safe and arming devices which utilize pneumatic operators to power the arming function.

2. Description of the Prior Art

Guided missiles launched from aircraft or from stationary launching devices are commonly designed to launch with an unarmed warhead, and to arm the warhead a predetermined time after launch. This prevents the possibility of the guided missile exploding prior to or during launch, and damaging the launching vehicle. One arming device which may be used to arm a guided missile warhead in response to the environmental conditions after launch, in U.S. Pat. No. 3,968,751 to Robert G. Palifka. This patent, entitled Arming Device, discloses a logic module system utilizing a spring energy storage means. The device is responsive to ram air pressure and utilizes a rotor and arming spring to translate linear piston motion into rotary motion. A series of interlocks prevent inadvertant arming of the device. Other safe and arming devices use gear train escapements and wind powered turbine wheels to provide a low RPM energy source for aligning an explosive train in response to slip stream air flow.

Prior art safe and arming devices which rely entirely on purely mechanical mechanisms or purely electrical circuits do not provide as adequate reliability of function and safety against premature function as do hybrid electro-mechanical devices.

SUMMARY OF THE INVENTION

The present invention overcomes some of the deficiencies in prior art safe and arming devices by incorporating electrical as well as mechanical aspects in a single device. A pneumatic piston and rod are supplied with fluid static and dynamic pressures on opposite faces so that force tending to operate the piston is proportional to the difference between static and dynamic pressures. This pressure differential is proportional to ordnance item velocity in a fluid and consequently is only great enough to stroke the piston after a predetermined minimum velocity has been obtained. Also, an electric signal must be sent to a rotary solenoid to unlock the rod to permit piston travel. Piston travel then loads a flexible coil spring until, at the extent of piston travel, a latching mechanism releases a disk to rotate on its axis under the influence of energy stored within the flexible coil spring. At the limit of disk rotation, a return spring on the rotary solenoid causes a detent ball to jam the disk in its fully rotated position, aligning an out-of-line explosive train and completing or opening various electric circuits in the arming, proximity, and contact fuse circuitry. Detonating signals from either the contact fuse or proximity fuse lead to instantaneous or delayed action detonators which begin detonation of the explosive train leading to a booster charge which detonates the warhead.

The present invention may advantageously be used in conjunction with the pressure probe described in U.S. Pat. No. 4,188,886 entitled "Pressure Probe For Safety Arming Device" and the electronic circuitry described in U.S. Pat. No. 4,212,246 entitled "Fuze Electronic Circuitry" both filed of even date herewith.

BRIEF DESCRIPTION OF THE DRAWING

Further advantages of the present invention will emerge from a description which follows of the preferred embodiment of a safe and arming device/contact fuse according to the invention given with reference to accompanying drawing Figures in which.

DESCRIPTION OF THE PREFERRED EMBODIMENT

Figure 1:
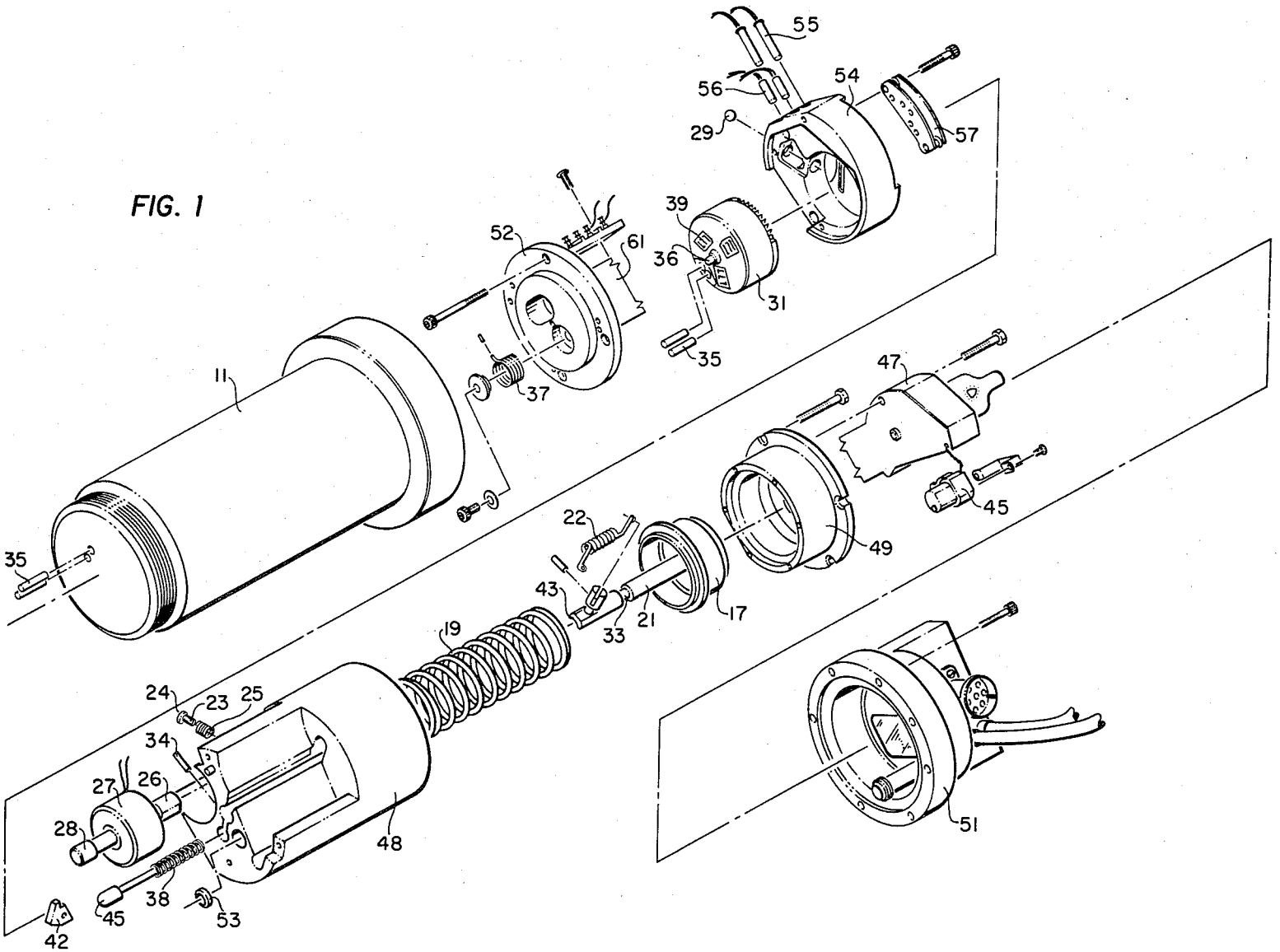
FIG. 1 illustrates an exploded perspective view of a safe and arming device according to the invention.

The present invention is a pneumatically operated safe and arming device which utilizes electro-mechanical interlocks to control movement of a piston and rod to store energy within a flexible coil spring. Energy stored within the spring is then made available to rotate a disk, thereby aligning an out-of-line explosive train and arming the device. Referring now to the drawings, wherein like reference numerals correspond to like parts and elements throughout the several Figures, there is shown in FIG. 1 an exploded view of a safe and arming device. The device, when assembled, fits within shell 11 for installation in a missile warhead. Major portions of the device include base plate 52, housing 48, cylinder head 49, disk 31, disk housing 54, piston 17 and shell end cap 51.

Figure 2:
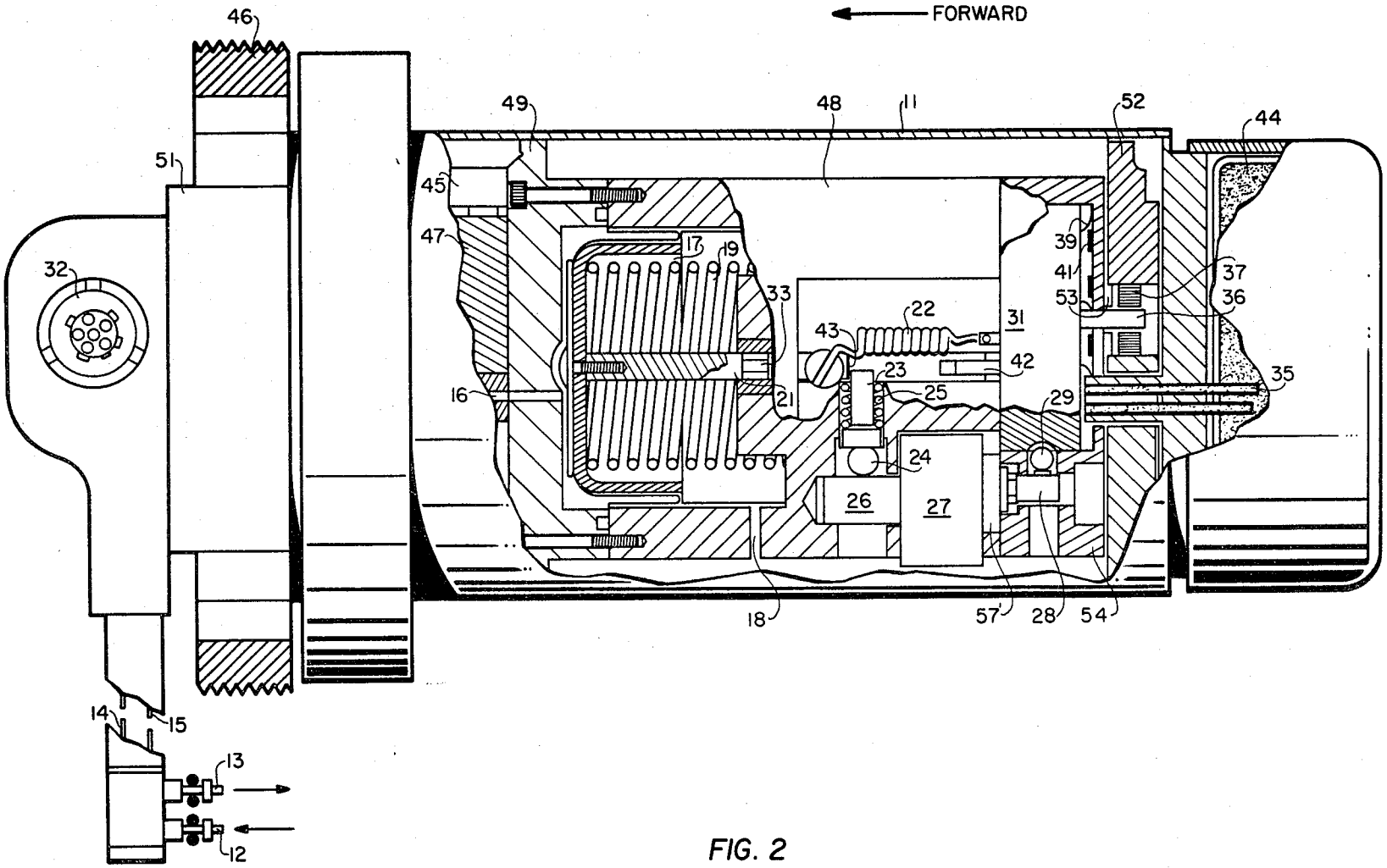
FIG. 2 illustrates a partially broken away sectional view of an assembled safe and arming device according to the invention.

Referring now to FIG. 2, the major parts described above are shown in their assembled relationships along with other parts. Static fluid pressure conduit 13 and dynamic fluid pressure conduit 12 are connected to apparatus not shown which samples fluid static and dynamic pressure on the exterior of the ordnance item in which the present invention is installed. Dynamic fluid pressure is conducted through dynamic pressure tubing 14 to dynamic fluid pressure passageway 16 and through cylinder head 49 to the upper volume of the cylinder head chamber. At the same time, static fluid pressure is conducted from static fluid pressure conduit 13 through static pressure tubing 15 to the interior of shell 11 where static pressure communicates with the lower volume of housing 48 piston chamber by means of static fluid pressure passageway 18. Of course static passageway 18 may simply represent leakage through housing 48, and is not necessarily a specific hole at any particular location. The lower volume in the piston chamber must be vented to ambient static fluid pressure however for the device to operate.

Piston 17 is shown within housing 48 and cylinder head 49. Piston 17 divides the central cylinderical chamber shown in FIG. 2 into upper and lower volumes which are air tight with respect to one another. Resilient spring 19 applies a biasing force to piston 17 urging it to remain in the position shown in FIG. 2. The strength of biasing spring 19 determines the differential between static and dynamic fluid pressure that is necessary in order for piston 17 to be stroked. Rod 21 is rigidly attached to piston 17 and provides output force to operate the remaining mechanism.

Rotary solenoid 27 has a shaft which operates first interlock camming lobe or cam 26 and and second interlock camming lobe or cam 28. Cam 26 bears against plunger 24 which is resiliently biased by plunger spring 25. The rotary position of cam 26 determines the extent that plunger end 23 protrudes to either block rod end 43 or enable movement of rod 21. Cam 28 and cam 26 are both attached to the same shaft and rotate simultaneously under the influence of rotary solenoid 27. Cam 28 operates detent ball 29 in a well in housing 54 against disk 31, controlling rotation of disk 31 and locking disk 31 in predetermined safe or armed positions.

Rotation of disk 31 is caused by energy stored within flexible coil spring 22 which attaches between rod 21 and disk 31. Spring 22, when loaded, buckles and flexes sideways to apply a lateral force to disk 31, rotating it when rotation is enabled.

Latching bar 42 maintains disk 31 in its initial position until sufficient energy has been stored within flexible coil spring 22 by the pressure induced stroking of piston 17. Rod end 43 contacts latching bar 42 at the extent of piston travel and pivots latching bar 42 to release disk 31 for spring powered rotation.

Disk 31 rotates against biasing spring 37 on disk shaft 36 and shaft bearing 53. As disk 31 rotates, electrical connections are made and broken by the placement of contacts 39 and 41 which are located according to the requirements of electrical system logic in the arming and fuzing circuits. Contacts 39 and 41 insure that the electrical fuzing portions of the device are inoperative until after disk 31 has been locked in the armed position. As rod end 43 releases latching bar 42, solenoid 27 is released and returns to its initial position under urging by a torsional spring 57'. As this occurs, cam 26 forces plunger end 23 into rod recess 33, while cam 28 forces detent ball 29 into a recess 29A on the periphery of disk 31. When the device is armed, a firing signal causes either instantaneous detonater 56 or delayed detonator 55 to begin detonation of an explosive train leading through disk 31 to output path 35 which leads to explosive booster charge 44. Detonation of explosive booster charge 44 causes detonation of warhead explosive 63 shown in FIG. 5.

Figure 3:
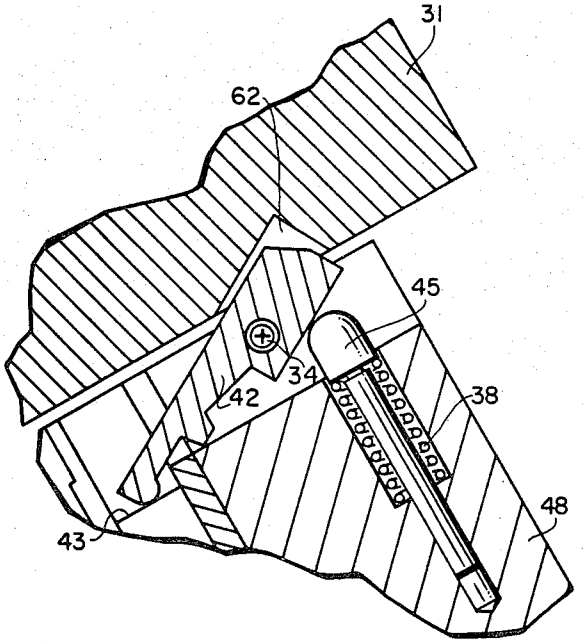
FIG. 3 illustrates a sectional view of a disk latching mechanism utilized in a safe and arming device according to the invention.

Referring now to FIG. 3 there is shown a portion of disk 31 having notch 62. Latching bar 42, pivots about pin 34 and is normally held in position engaging notch 62 by latching plunger 45 which is spring loaded by coil spring 38. Latching plunger 45 and coil spring 38 are retained within a well in housing 48 by the end of latching bar 42. Rod end 43 at the extreme of its travel, contacts latching bar 42 and pivots bar 42 about pin 34, depressing spring loaded plunger 45 and disengaging notch 62 in disk 31. This releases disk 31 to rotate.

Figure 4:
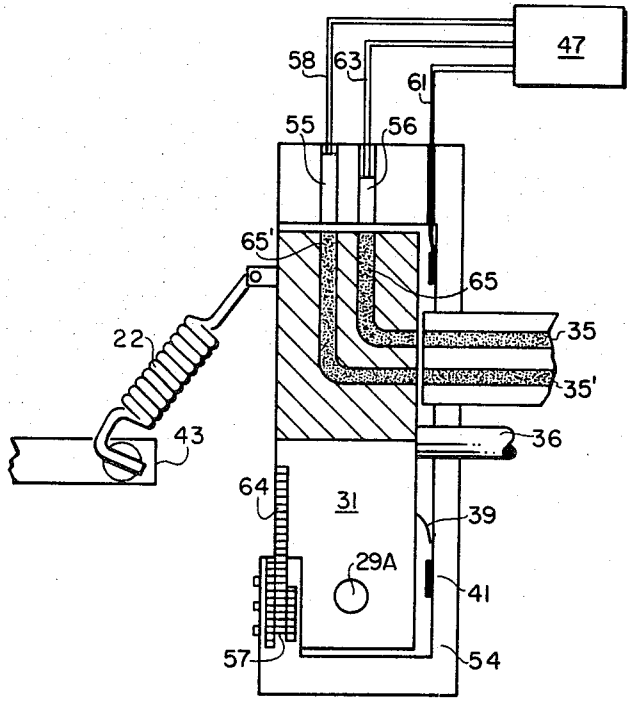
FIG. 4 illustrates, partially in section, a partially schematic view of a disk having explosive paths according to invention.

Referring now to FIG. 4 there is shown disk 31 partially in section, and delayed detonator 55 and instantaneous detonator 56. Electrical leads 58, 63 and 61 leading from the detonators and switching structure respectively, lead to electronic circuit housing 47 wherein electrical circuitry provides system logic. Delayed explosive path 65' and instantaneous explosive path 65, both within disk 31, align with explosive output paths 35 and 35' respectively when disk 31 is armed. Spring induced rotation of disk 31 is buffered by gear train escapement 57 which engages peripheral gear teeth 64 on disk 31.

Figure 5:
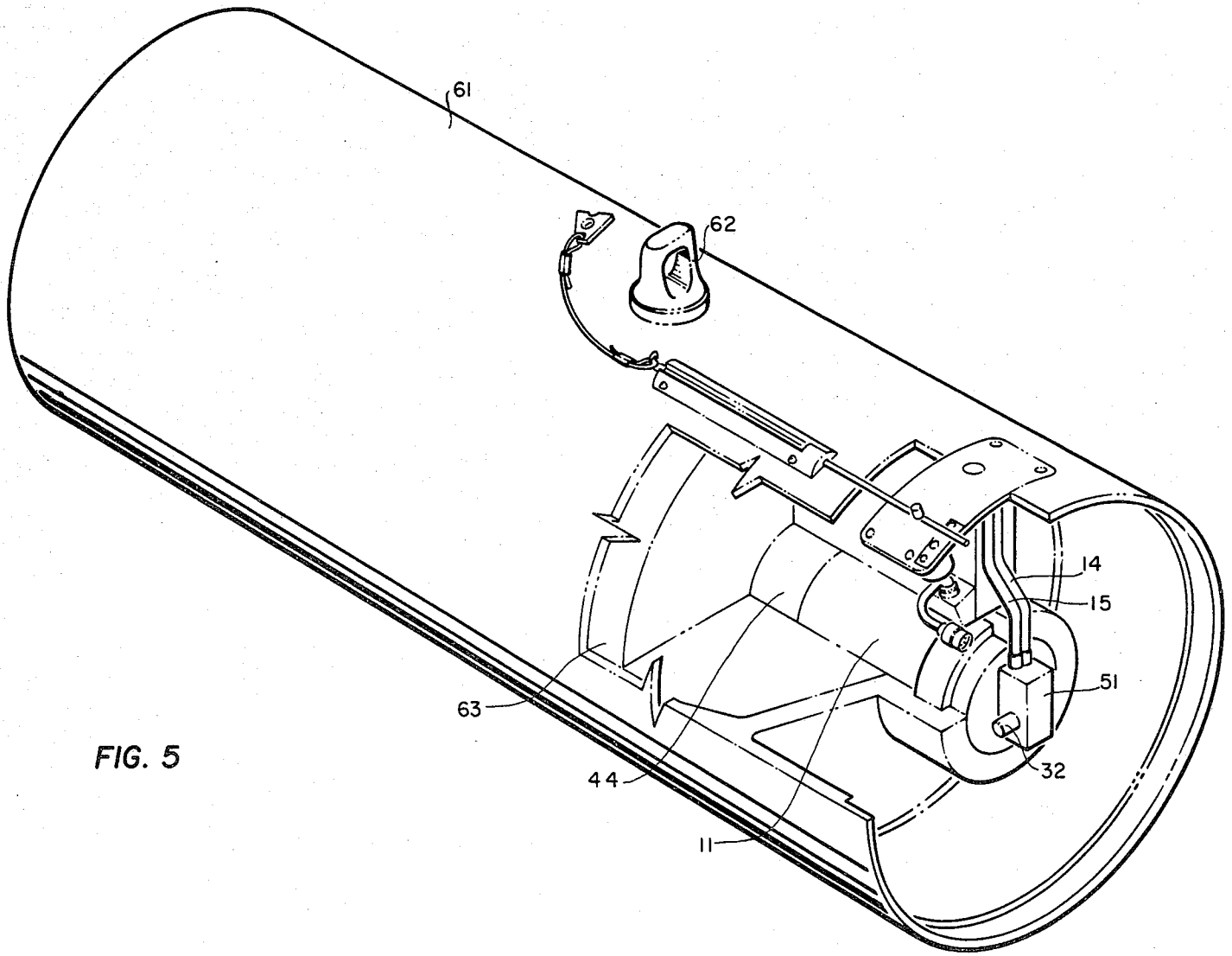
FIG. 5 illustrates the placement of a safe and arming device according to the present invention within a missile warhead.

Referring now to FIG. 5 the safety and arming device is shown installed in missile warhead 61. Forward suspension lug 62 provides means for attaching the missile to launching apparatus. Also shown for use with the present invention are a lanyard connected to an arming wire which is threaded through an arming wire conduit to a pressure probe switch. Upon launch of the missile, the lanyard is pulled from the switch enabling it to close and fire an explosive charge which erects a pressure sampling probe to supply missile ambient dynamic and static fluid pressure by means of dynamic pressure tubing 14 and static pressure tubing 15 to the safe and arming device of the present invention. Electrical connection fitting 32 provides means for connecting the present safe and arming device into the total missile electrical circuitry. Electrical connection fitting 32 is a conventional fitting. Shell end cap 51 has peripheral threaded section 46 for securing the device within missile warhead 61. A contact fuze 45 which communicates with electronic circuitry in the safety and arming device, provides a means for distinguishing between proximity detonation which requires instantaneous detonation for maximum salvable effect, and delayed detonation for maximum combat effect in a direct hit situation. Direct hits on a target cause the contact fuze to close, lock out the proximity fuze, and initiate the delay detonators so that the guided missile may penetrate the target before detonating.

In operation, the present invention is installed within a guided missile. Just after launch, a pressure probe extends to sample fluid static and dynamic pressure. This pressure is fed to volumes on each side of piston 17, and as missile velocity increases the pressure differential across piston 17 also increases. At a predetermined point an electric signal is sent to solenoid 27 causing it to rotate, thereby causing cams 26 and 28 to permit plunger 24 and detent ball 29 to release rod 21 and disk 31 respectively. At this time disk 31 is still held locked in position by latching bar 42. As pressure differential on piston 17 increases, the pressure eventually overcomes the retarding force from resilient spring 19, and piston 17 begins to travel toward disk 31. As rod 21 approaches disk 31, energy is stored within flexible coil spring 22. Near the end of rod travel, rod end 43 operates latching bar 42 releasing disk 31. As disk 31 rotates, the contact pairs, such as 39 and 41 open and close at predetermined intervals so that electric current to solenoid 27 is interrupted, causing solenoid 27 to return to its initial position under urging of torsional spring 57'. When this occurs, cam 26 extends plunger end 23 into rod recess 33 locking rod 21 in its stroked position. Also, cam 28 jams detent ball 29 into detent recess 29A, locking disk 31 in the armed position.

The present invention enables arming to occur only after a predetermined pressure differential between fluid static and dynamic pressure, corresponding to a preselected minimum flight speed, has been obtained. This preselected minimum flight speed may advantageously be selected to be approximately 220 mph, or any other desired speed.

Obviously many modifications and variations of the present invention are possible in the light of the above teaching. It is therefore to be understood that within the scope of the appended claims, the invention may be practiced otherwise than as specifically described.

What is claimed is:

1. A pneumatically operated safe and arm device for use in an ordnance item in a fluid environment, comprising:

a housing having an interior chamber;

a piston sealingly retained within said housing and dividing said chamber into first and second volumes, said piston including a rigidly attached output rod having a free end, said piston and output rod being movable linearly between first and second positions and resiliently urged toward said first position;

a disk mounted to said housing and rotatable about an axis between safe and armed positions, said disk including at least two explosive paths, each path having at least two exposed ends, and said disk being resiliently urged toward said safe position;

resilient force transmission means linking said rod and said disk for converting linear rod motion to rotational disk motion;

dynamic pressure means communicating between said fluid environment and said interior chamber for supplying fluid dynamic pressure to said first volume;

static pressure means communicating between said fluid environment and said interior chamber for supplying fluid static pressure to said second volume;

first interlock means releasably engaging said rod in a locking position for preventing said linear rod motion, said first interlock means being movable between said locking position and a releasing position, and resiliently urged toward said releasing position;

second interlock means releasably engaging said disk in a jamming position for preventing rotation of said disk, said second interlock means being movable between said jamming position and a freeing position;

a rotary solenoid attached to said housing, having a shaft configured for rotation between preventing and enabling positions, and being resiliently urged toward said preventing position, said shaft having first and second camming lobes contacting and operating said first and second interlock means respectively in response to rotation of said shaft;

disk latching means pivotally attached to said housing and releasably engaging said disk in a storing position, said disk latching means being pivotal between said storing position and a tripping position, and resiliently urged toward said storing position, for releasing said disk in response to said output rod moving from said first position to said second position;

instantaneous detonation means attached to said housing and positioned in alignment with one end of one of said explosive paths in said disk in said armed position for instantaneously detonating said one explosive path in response to a first signal;

delay detonation means attached to said housing and positioned in alignment with one end of the other of said explosive paths in said disk in said armed position for delayably detonating said other explosive path in response to a second signal; and detonation output means attached to said housing and positioned in alignment with said other ends of said explosive paths in said disk in said armed position for directing detonation energy from detonation of at least one of said explosive paths to the exterior of said housing; whereby relative movement of said ordnance item in said fluid environment results in fluid static and dynamic pressures being applied to said piston, said relative movement at velocities greater than a preselected minimum causing said piston, enabled by release of said first interlock means, to load said resilient force transmission means and trigger rotation of said disk, thereby aligning an explosive train.

2. A pneumatically operated safe and arm device as set forth in claim 1 wherein said resilient force transmission means comprises a flexible coil spring.

3. A pneumatically operated safe and arm device as set forth in claim 1 wherein said delay detonation means comprises an electrically initiated detonator having a pyrotechnic delay.

4. A pneumatically operated safe and arm device as set forth in claim 1 wherein said resiliently urged first interlock means comprises a spring loaded plunger.

5. A pneumatically operated safe and arm device as set forth in claim 1 wherein said first interlock means in said locking position contacts said free end of said rod in said first position.

6. A pneumatically operated safe and arm device as set forth in claim 1 wherein said rod defines a recess positioned between said free end and said piston for engaging said first interlock means in said second rod position and said first interlock means locking position respectively.

7. A pneumatically operated safe and arm device as set forth in claim 1, further including:

an electric arming and fuzing circuit connected to said instantaneous detonation means, said delay detonation means, and said rotary solenoid;

said electric circuit having a plurality of contact pairs for performing switching operations, one of said contacts in each of said contact pairs being attached to said disk and the other of said contacts in each of said contact pairs being attached to said housing and positioned for contact with said one of said contacts in response to the rotational position of said disk.

8. A pneumatically operated safe and arming device as set forth in claim 1 wherein said second interlock means comprises:

said housing defining a cylindrical well having an opening adjacent the periphery of said disk;

a detent ball retained within said well; and a plurality of recesses in said disk periphery for partially receiving said ball, said recesses being positioned relative to said explosive paths to define said safe and armed positions.

* * * * *